US009396852B2

(12) United States Patent
Hashimoto et al.

(10) Patent No.: US 9,396,852 B2
(45) **Date of Patent: *Jul. 19, 2016**

(54) R-T-B BASED PERMANENT MAGNET

(71) Applicant: TDK CORPORATION, Tokyo (JP)

(72) Inventors: Ryuji Hashimoto, Tokyo (JP); Kenichi Suzuki, Tokyo (JP); Kyung-ku Choi, Tokyo (JP)

(73) Assignee: TDK CORPORATION, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 14/261,516

(22) Filed: Apr. 25, 2014

(65) Prior Publication Data

US 2014/0320245 A1 Oct. 30, 2014

(30) Foreign Application Priority Data

Apr. 25, 2013 (JP) ..... 2013-092236

(51) Int. Cl.
*H01F 1/057* (2006.01)
*H01F 10/12* (2006.01)

(52) U.S. Cl.
CPC ..... *H01F 1/057* (2013.01); *H01F 10/126* (2013.01)

(58) Field of Classification Search
CPC ... H01F 41/0293; H01F 1/0572; H01F 1/053; H01F 1/0552; H01F 7/02; C23C 14/18; C23C 26/00; B32B 15/01
See application file for complete search history.

(56) References Cited

U.S. PATENT DOCUMENTS

| | | | | |
|---|---|---|---|---|
| 4,770,723 | A | 9/1988 | Sagawa et al. | |
| 5,089,065 | A * | 2/1992 | Hamano et al. | 148/302 |
| 2003/0079805 | A1 | 5/2003 | Hamada et al. | |
| 2008/0050581 | A1 | 2/2008 | Miwa et al. | |
| 2008/0054738 | A1 | 3/2008 | Komuro et al. | |
| 2008/0241368 | A1 | 10/2008 | Komuro et al. | |
| 2008/0241513 | A1 | 10/2008 | Komuro et al. | |
| 2013/0093551 | A1 * | 4/2013 | Peng et al. | 335/302 |
| 2013/0135069 | A1 | 5/2013 | Miyamoto et al. | |
| 2014/0320243 | A1 * | 10/2014 | Hashimoto et al. | 335/302 |
| 2014/0320244 | A1 | 10/2014 | Hashimoto et al. | |
| 2014/0320246 | A1 | 10/2014 | Hashimoto et al. | |

FOREIGN PATENT DOCUMENTS

| | | | |
|---|---|---|---|
| JP | A-59-46008 | | 3/1984 |
| JP | H-06-942 | B2 | 1/1994 |
| JP | H-06-2930 | B2 | 1/1994 |
| JP | H-06-112026 | A | 4/1994 |
| JP | H-06-6776 | B2 | 10/1994 |
| JP | 2005-286152 | A | 10/2005 |
| JP | A-2008-60183 | | 3/2008 |
| JP | 2008-263208 | A | 10/2008 |
| JP | A-2008-266767 | | 11/2008 |
| JP | A-2008-270699 | | 11/2008 |
| JP | 2011-187624 | A | 9/2011 |
| JP | A-2012-39100 | | 2/2012 |
| JP | A-2012-043968 | | 3/2012 |
| JP | B1-5370609 | | 9/2013 |
| WO | WO 2012003702 | A1 * | 1/2012 |

OTHER PUBLICATIONS

Uehara, Journal of Magnetism and Magnetic Materials 284 (2004) 281-286.*
May 20, 2014 Decision for Granting a Patent issued in Japanese Patent Application No. JP 2013-092236 w/translation.
Jul. 28, 2014 Office Action issued in U.S. Appl. No. 14/257,206.
Dec. 10, 2014 Office Action issued in U.S. Appl. No. 14/262,156.
Nov. 14, 2014 Office Action issued in U.S. Appl. No. 14/257,541.
May 20, 2014 Decision for Granting a Patent in Japanese Patent Application No. JP2013-092235.
May 20, 2014 Decision for Granting a Patent issued in Japanese Patent Application No. 2013-092238.
Nov. 20, 2014 Office Action issued in U.S. Appl. No. 14/257,206.

* cited by examiner

*Primary Examiner* — Jie Yang
*Assistant Examiner* — Xiaowei Su
(74) *Attorney, Agent, or Firm* — Oliff PLC

(57) ABSTRACT

The present invention provides such a permanent magnet that its magnetic properties will not significantly decrease and it can be prepared at a lower temperature, compared to conventional R-T-B based permanent magnets. In the R-T-B based structure, a stacked structure of R1-T-B based crystal layer and Ce-T-B based crystal layer can be formed by alternatively stacking the R1-T-B based crystal layer and the Ce-T-B based crystal layer. In this way, a high magnetic anisotropy field of the R1-T-B based crystal layer can be maintained while the crystallization temperature can be lowered by the Ce-T-B based crystal layer.

4 Claims, No Drawings

R-T-B BASED PERMANENT MAGNET

The present invention relates to a rare earth based permanent magnet, especially a permanent magnet obtained by selectively replacing part of the R in the R-T-B based permanent magnet with Ce.

BACKGROUND

The R-T-B based permanent magnet (R represents a rare earth element, and T represents Fe or Fe with part of it replaced by Co) comprising a tetragonal compound $R_2T_{14}B$ as the major phase is known to have excellent magnetic properties, and has been considered as a representative permanent magnet with good performances since it was invented in 1982 (Patent Document 1: Japanese Laid-Open Patent Publication No. Sho 59-46008).

In particular, the R-T-B based permanent magnets in which the rare earth element R consists of Nd, Pr, Dy, Ho or Tb have large magnetic anisotropy fields Ha, and are widely used as permanent magnet materials. Of those, the Nd—Fe—B based permanent magnet having Nd as the rare earth element R is widely used in people's livelihood, industries, transportation equipment and the like, because it has a good balance among saturation magnetization Is, curie temperature Tc and magnetic anisotropy field Ha. However, the use of the R—Fe—B based permanent magnet has become wider and wider in recent years, causing a rapid increase in the consumption of Nd or Pr and the like. Thus, Nd or Pr and the like as the precious resource is required to be effectively used and the material cost of the R—Fe—B based permanent magnet is required to be lowered.

In another respect, there is a problem that the R—Fe—B based permanent magnet requires a large amount of energy for the crystallization. Further, there is also a problem that, if a thermal treatment is provided at a high temperature to perform the crystallization, the magnetic properties will be deteriorated due to the mix of impurities from surrounding environment. In this respect, it is required that the R—Fe—B based permanent magnet can be crystallized at a low temperature.

PATENT DOCUMENTS

Patent Document 1: Japanese Laid-Open Patent Publication No. Sho 59-46008

Patent Document 2: Japanese Patent Publication No. Hei 6-6776

Patent Document 3: Japanese Patent Publication No. Hei 6-942

Patent Document 4: Japanese Patent Publication No. Hei 6-2930

Ce is known as a rare earth element R that has the lowest melting point and the lowest eutectic temperature with Fe among the rare earth elements, and can form an R-T-B based crystal layer at a low temperature. In addition, Ce is rich in resource volume and shows a high coercivity. Patent Document 2 relates to a sintered magnet and a resin-bonded magnet with low cost and high performance. That is, such a magnet has a composition of Ce—La-(didymium; an Nd—Pd alloy)-Fe added by the semimetal(s) and is represented by the formula of $Ce_{1-x-y-z}Pr_xNd_yLa_z(Fe_{1-m}M_m)_n$ in the form of atomic ratios, wherein M consists of one or two or more elements selected from the group consisting of B, C, Si, Ge, P and S, the x, y, z, t, m and n fall within the ranges of $0.1 \le x \le 0.5$, $0.1 \le y \le 0.85$, $0 \le z \le 0.1$, $0.02 \le m \le 0.1$, $0 \le n \le 8.0$ and $0 < 1-x-y-z < 0.8$. Here, La is an essential. In the properties of this kind of magnet, the coercivity is 581 kA/m or more.

Further, Patent Document 3 also relates to a sintered magnet and a resin-bonded magnet with a low cost and high performance. It has a composition that Ce—La-(didymium; an Nd—Pd alloy)-Fe—B is substituted with Co, and the coercivity can be 629 kA/m.

In addition, Patent Document 4 also relates to a sintered magnet and a resin-bonded magnet with a low cost and high performance. It has a composition that Ce—La-(didymium; an Nd—Pd alloy)-Fe is substituted with M, and the coercivity can be 597 kA/m or more. The coercivity of each of these magnets is much lower than that of the Nd-T-B based magnet which is about 796 kA/m. Thus, it is difficult to use them to replace the conventional Nd-T-B based magnets.

SUMMARY

The present invention is achieved by recognizing the above-mentioned situation. It is an object of the present invention to provide such a permanent magnet that its magnetic properties will not significantly decrease and it can be produced at a low temperature, compared to the R-T-B based permanent magnet widely used in people's livelihood, industries, transportation equipment and the like.

To solve the problems mentioned above and to achieve the object, a permanent magnet is provided which has a R-T-B based structure in which a R1-T-B based crystal layer (wherein, R1 represents at least one rare earth element except Ce, and T represents at least one transition metal element containing Fe or the combination of Fe and Co as an essential) and a Ce-T-B based crystal layer are stacked. With such a structure, a permanent magnet can be obtained that its magnetic properties will not significantly decrease and it can be produced at a low temperature, compared to the conventional R-T-B based permanent magnets.

In the present invention, R includes R1 and Ce. In this respect, Ce which is rich in resource volume can be effectively utilized. In addition, Ce has the lowest melting point and the lowest eutectic temperature with Fe, among the rare earth elements, and can form an R-T-B based crystal layer at a low temperature. On the other hand, there is a problem that the magnetic anisotropy field will be decreased. Thus, the inventors have found that by stacking the R1-T-B based crystal layer and the Ce-T-B based crystal layer, a high magnetic anisotropy field of the R1-T-B based crystal layer can be maintained while the crystallization temperature can be lowered by the Ce-T-B based crystal layer, and have completed the present invention.

The crystallization temperature of R1-T-B can also be lowered by alternatively stacking R1-T-B and Ce-T-B. Specifically, the Ce-T-B based crystal layer is formed at a low crystallization temperature and then the R1-T-B is stacked on the Ce-T-B based crystal layer, thereby the eutectic temperature around the boundary is decreased. Therefore, the R1-T-B crystal can also be formed even under a low temperature. Thereafter, the R1-T-B based crystals formed around the boundary grow so that the crystallization temperature of the whole R1-T-B phase is lowered.

In the R-T-B based permanent magnet of the present invention, the atomic ratio of R1 to Ce (i.e., R1/Ce) preferably ranges from 0.1 to 10. By setting the atomic ratio in this range, a balance is achieved between the high magnetic anisotropy field of the R1-T-B based crystal layer and the effect that the crystallization temperature of the Ce-T-B based crystal layer can be lowered. Particularly, good magnetic properties can be achieved.

In the R-T-B based permanent magnet of the present invention, it is preferred that the thickness of each of the R1-T-B based crystal layer and the Ce-T-B based crystal layer is 0.6 nm or more and 300 nm or less. By setting the thicknesses of these layers to this range, the coercivity inducement mechanisms from the single magnetic domains are also partially generated. Particularly, a high coercivity can be achieved.

In the present invention, a coercivity relatively higher than that in the R-T-B based permanent magnet using Ce as R can be maintained, by stacking the R1-T-B based crystal layer and the Ce-T-B based crystal layer in the R-T-B based permanent magnet with the addition of Ce. Further, the crystallization temperature can be lowered compared to the conventional R-T-B based permanent magnets using Nd, Pr, Dy, Ho and/or Tb as the R.

DETAILED DESCRIPTION OF EMBODIMENTS

The ways for carrying out the present invention (embodiments) are described in detail. However, the present invention is not limited by the following embodiments. In addition, the elements described below may contain elements easily assumed by those skilled in the art and elements which are substantially the same. In addition, the elements described below can be appropriately combined.

The R-T-B based permanent magnet of the present embodiment contains 11 to 18 at % of rare earth elements. Here, the R in the present invention comprises R1 and Ce as the essential ingredients. R1 represents at least one rare earth elements except Ce. If the amount of R is lower than 11 at %, the generation of the $R_2T_{14}B$ phase contained in the R-T-B based permanent magnet is not sufficient, the soft magnetic α-Fe and the like will precipitate, and the coercivity will be significantly reduced. On the other hand, if the amount of R is more than 18 at %, the volume ratio of the $R_2T_{14}B$ phase will decrease and the residual flux density will decrease. Further, as R reacts with O, while the amount of O contained therein increases, the R-rich phase effective in coercivity generation will decrease, resulting in the decrease of the coercivity.

In the present embodiment, the rare earth element R mentioned above contains R1 and Ce. R1 represents at least one rare earth element except Ce. Here, R1 may also contain other ingredients which are impurities derived from the starting material or impurities mixed during the production process. In addition, if a high magnetic anisotropy field is considered to be desired, R1 is preferred to be Nd, Pr, Dy, Ho and/or Tb. In view of the price of the starting materials and the corrosion resistance, Nd is more preferable.

The R-T-B based permanent magnet of the present embodiment contains 5 to 8 at % of B. If the amount of B is less than 5 at %, a high coercivity cannot be achieved. On the other hand, if the amount of B is more than 8 at %, the residual magnetic density tends to decrease. Thus, the upper limit of the amount of B is set to 8 at %.

The R-T-B based permanent magnet in the present embodiment may contain 4.0 at % or less of Co. Co forms a same phase as Fe, but it is effective in the improvement of the Curie temperature and the corrosion resistance of the grain boundary phase. Further, the R-T-B based permanent magnet in the present embodiment may contain 0.01 to 1.2 at % of one of Al and Cu or both. By containing one of Al and Cu or both with the mentioned range, high coercivity, high corrosion resistance and improved temperature characteristics of the resulting permanent magnet can be achieved.

The R-T-B based permanent magnet of the present embodiment is allowed to contain other elements. For example, elements such as Zr, Ti, Bi, Sn, Ga, Nb, Ta, Si, V, Ag, Ge and the like can be appropriately contained. On the other hand, it is preferred that the impurity elements such as O, N, C and the like are decreased to an extremely low level. Particularly, the amount of O, which damages the magnetic properties, is preferably 5000 ppm or less and more preferably 3000 ppm or less. This is because the phase of rare earth oxides as the non-magnetic ingredients will increase in volume if O is contained in a large amount, leading to lowered magnetic properties.

The R-T-B based permanent magnet of the present embodiment has an R-T-B based structure in which the R1-T-B based crystal layer and the Ce-T-B based crystal layer are stacked. With the stacking of the R1-T-B based crystal layer and the Ce-T-B based crystal layer, the high magnetic anisotropy field of the R1-T-B based crystal layer can be maintained while the crystallization temperature can be lowered by the Ce-T-B based crystal layer.

Here, the atomic ratio of R1 to Ce (i.e., R1/Ce) is preferably in the range of 0.1 or more and 10 or less. By setting the atomic ratio to this range, a balance is achieved between the high magnetic anisotropy field of the R1-T-B based crystal layer and the effect of decreasing the crystallization temperature of the Ce-T-B based crystal layer. Particularly, high magnetic properties can be achieved. However, it is not limited to this atomic ratio such as when one layer is stacked on the surface and local improvement is aimed.

Further, the thickness of each of the R1-T-B based crystal layer and the Ce-T-B based crystal layer is preferably 0.6 nm or more and 300 nm or less. With respect to the critical particle size in the single magnetic domain, it is about 300 nm for both $Nd_2T_{14}B$ and $Ce_2Fe_{14}B$. Thus, by stacking each layer with a thickness equal to or thinner than the critical particle size respectively, the coercivity inducement mechanisms from the single magnetic domain are also partially generated from the nucleation type which is the general coercivity inducement mechanism in the R-T-B based permanent magnet. Thus, high coercivity is achieved. On the other hand, the interatomic distance in the c-axis direction is about 0.6 nm in the crystal structure of $R_2T_{14}B$. If the layer thickness is 0.6 nm or less, the stacked structure of the R1-T-B based crystal layer and the Ce-T-B based crystal layer cannot be formed. If stacking is performed with a thickness smaller than 0.6 nm, a crystal structure of $R_2T_{14}B$ in which part of R1 and Ce are randomly arranged will be obtained.

Hereinafter, the preferred examples of the production method in the present invention are described.

The methods for producing the R-T-B based permanent magnet include methods of sintering, rapidly quenched solidification, vapor deposition, HDDR and the like. An example of the production method performed by sputtering in vapor deposition is described below.

As the material, the target materials are prepared first. The target materials are R1-T-B alloyed target material and Ce-T-B alloyed target material with a desired composition. Here, as the sputtering yield of each element is different, there may be deviation between the composition ratio of the target materials and the composition ratio of the film formed by sputtering, and adjustment is needed. When a device with three or more sputtering means is used, single-element target materials for each of R1, Ce, T and B may be prepared so as to perform the sputtering in desired ratios. Further, the sputtering may also be performed in desired ratios by using materials with a part of alloyed target materials such as R1, Ce and T-B. Similarly, when other elements such as Zr, Ti, Bi, Sn, Ga, Nb, Ta, Si, V, Ag, Ge and the like are needed to be contained appropriately, they may also be contained by using the two methods using the alloyed target materials and single-element target materials respectively. On the other hand, the impurity elements such as O, N, C and the like are preferably reduced as much as possible, so the amount of the impurities contained in the target materials is also reduced as much as possible.

During storage, the target materials are oxidized from the surfaces. Particularly, the oxidation proceeds quickly when single-element target materials of rare earth elements such as R1 and Ce are used. Therefore, before the use of these target materials, sufficient sputtering is essential so as to expose their clean surfaces.

As for the base material which is film-formed by sputtering, various metals, glass, silicon, ceramics and the like can be selected to use. Since the treatment at a high temperature is essential to get a desired crystal structure, materials with high melting points are preferred. Furthermore, in addition to the resistance against the high-temperature treatment, as a measure to solve the problem that sometimes the adhesion to the R-T-B film is not sufficient, to improve the adhesion by providing a base film made of Cr or Ti, Ta, Mo and the like is usually performed. To prevent the oxidation of the R-T-B film, a protection film made of Ti, Ta, Mo and the like can be provided on the top of the R-T-B film.

With respect to the film-forming device for sputtering, since it is preferred that impurity elements such as O, N, C and the like are maximally decreased, the vacuum chamber is preferably evacuated to $10^{-6}$ Pa or less, more preferably $10^{-8}$ Pa or less. To keep a high vacuum state, a base material supply chamber which connects to the film-forming chamber is preferably provided. Then, since it is essential to perform sputtering sufficiently so as to expose the clean surfaces of the target materials before the use of the target materials, the firm-forming device preferably includes a shield means which can be operated under a vacuum state between the base materials and the target materials. As for the method for sputtering, in order to maximally decrease the amount of impurity elements, the method of magnetron sputtering which can be performed under Ar atmosphere with a lower pressure is preferred. Here, since the target materials containing Fe and Co could significantly decrease the leakage and the sputtering would be hard, it is necessary to choose a proper thickness of the target material. The power for sputtering can be any one of DC and RF, depending on the target materials.

In order to use the target materials and base materials mentioned above to prepare a stacked structure of the R1-T-B based crystal layer and the Ce-T-B based crystal layer, the sputtering of the R1-T-B alloyed target material and that of the Ce-T-B alloyed target material are alternatively performed. When the single-element target materials for each of R1, Ce, T and B are used, the sputtering of the three target materials of R1, T and B is performed in a desired ratio followed by the sputtering of the three target materials of Ce, T and B in a desired ratio. By repeating the sputtering alternatively, it is possible to obtain a stacked structure similar to that obtained by using the alloyed target materials. During the sputtering of the three target materials such as R1, T and B as well as Ce, T and B, the sputtering can be performed by either simultaneous sputtering of three target materials or multilayer sputtering in which each element is sputtered individually. Even in the case of multilayer sputtering, the R-T-B based crystal structure is formed due to the thermodynamic stability by performing the stacking with proper ratios and thicknesses followed by heating. Further, the stacked structure can be prepared by transporting the base materials within the film-forming device to perform the sputtering of different target materials in separate chambers.

The number of the repetitions in the stacked structure can be set to any number of at least one set, wherein one set is obtained by stacking a R1-T-B based crystal layer and a Ce-T-B based crystal layer.

The thickness of the R-T-B based crystal layer refers to that beginning from one end portion to the other end portion in the plane that R, Fe and B exist. The crystal structure of $R_2T_{14}B$ can be easily recognized because it is constructed by stacking the plane that R, Fe and B exist and the layer composed of Fe (referred to as the σ layer) in the c-axis direction.

The thicknesses of the R1-T-B based crystal layer and the Ce-T-B based crystal layer in the stacked structure can be set to any thicknesses by adjusting the powder and process duration of the sputtering. By setting a difference between the thickness of the R1-T-B based crystal layer and that of the Ce-T-B based crystal layer, the atomic ratio of the R1 to Ce (R1/Ce) can be adjusted. Further, it is also possible to provide a thickness gradient by varying the thicknesses in each repeat. Here, it is necessary to determinate the rate of film-forming in advance for the thickness adjustment. The determination of the rate of film-forming is performed by measuring the film formed with a predetermined power in a predetermined time using a touch-typed step gauge. Also, a crystal oscillator film thickness gauge and the like provided in a film-forming device can also be used.

In the sputtering, the base material is heated at 400 to 700° C. and crystallized accordingly. On the other hand, during the sputtering, it is also possible to crystallize the base material by maintaining the base material at room temperature and subjecting it to a thermal treatment at 400 to 1100° C. after the film formation. In this respect, the R-T-B film after film formation is usually composed of fine crystals of about a few tens of nanometers or amorphous substance, and the crystal grows by the thermal treatment. To reduce the oxidation and nitridation as much as possible, the thermal treatment is preferably performed under vacuum or inert atmosphere. For the same purpose, it is more preferably that the thermal treatment means and the film-forming device can be transported under vacuum. The thermal treatment is preferably performed in short time and it will be sufficient if the time is 1 minute to 1 hour. Also, the heating process in the film formation and the thermal treatment may be performed in any combination.

Here, the R1-T-B based crystal layer and the Ce-T-B based crystal layer are crystallized by the energy from the sputtering and the energy from the heat to the base material. The energy from sputtering allows the sputtering particles attached to the base material and will disappear once the crystal forms. On the other hand, the energy from the heat to base material is provided continuously during film formation. However, with the thermal energy at 400 to 700° C., the diffusion of the R1-T-B based crystal layer and the Ce-T-B based crystal layer barely proceeds so that the stacked structure is maintained. The same happens in the thermal treatment after film formation at a low temperature. That is, while the growth of the particles of fine crystal proceeds by the thermal energy at 400 to 1100° C., the diffusion of the R1-T-B based crystal layer and the Ce-T-B based crystal layer barely proceeds so that the stacked structure is maintained. However, due to the thermodynamic stability, diffusion will sometimes happens at an interface other than the R-T-B based crystal layer, such as the base layer.

The crystallization temperature of R1-T-B can also be lowered by alternatively stacking R1-T-B and Ce-T-B. First of all, as Ce has the lowest melting point and the lowest eutectic temperature with Fe among the rare earth elements, the Ce-T-B based crystal layer can be formed at a low crystallization temperature. Then, R1-T-B is stacked on the Ce-T-B based crystal layer, whereby the eutectic temperature around the boundaries is decreased, therefore it is considered that the R1-T-B crystal can be formed even at a low temperature. Thereafter, the R1-T-B based crystal layer generated around the boundaries grows so that the crystallization temperature of the total R1-T-B phase can be lowered. In addition, the effect of decreasing the crystallization temperature of the total R1-T-B phase is always a phenomenon induced in the uppermost surface, so the bad situation that the base layer is easy to diffuse will not occur.

Although the stacked body produced in the present embodiment can be directly used as a film magnet as it is, it can also be further prepared into a rare earth based bond magnet or a rare earth based sintered magnet. The method of production will be described below.

An example of the production method for the rare earth based bond magnet will be described. First of all, the film made by sputtering with a stacked structure is peeled from the base material and then be subjected to fine pulverization. Thereafter, in the pressurized kneading machine such as the pressurized kneader, the resin binder containing resins as well as the main powders are kneaded, and the compound (composition) for rare earth based bond magnet are prepared, wherein the compound contains the resin binder and the powder of R-T-B based permanent magnet with a stacked structure. The resin includes thermosetting resins such as epoxy resin, phenolic resin and the like; or thermoplastic resins such as styrene-based, olefin-based, polyurethane-based, polyester-based, polyamide-based elastomers, ionomers, ethylene-propylene copolymer (EPM), ethylene-ethyl acrylate copolymer and the like. Of these, the resin used in compression molding is preferably the thermosetting resin and more preferably the epoxy resin or the phenolic resin. In addition, the resin used in injection molding is preferably the thermoplastic resin. Further, if desired, coupling agent or other additives may be added in the compound for the rare earth based bond magnet.

As for the ratio of the R-T-B based permanent magnet powders and the resins contained in the rare earth based bond magnet, it is preferred that 0.5 mass % or more and 20 mass % or less of resins are contained based on 100 mass % of main powders. Based on 100 mass % of R-T-B based permanent magnet powders, if the amount of the resins is less than 0.5 mass %, the shape retention tends to be impaired. If the amount of the resins is more than 20 mass %, it tends to be hard to achieve magnetic properties excellent enough.

After the production of the compound for the rare earth based bond magnet, by subjecting the compound for the rare earth based bond magnet to injection molding, a rare earth based bond magnet can be obtained which contains the R-T-B based permanent magnet powders with a stacked structure and resins. If the rare earth based bond magnet is prepared by injection molding, the compound for the rare earth based bond magnet is heated to the fusion temperature of the binder (the thermoplastic resin) and becomes flow state if needed. Then, the compound for the rare earth based bond magnet is subjected to the injection molding in a mold with a predetermined shape and molded. Then, after cooled down, the molded product (i.e., the rare earth based bond magnet) with a predetermined shape is taken out from the mold. In this way, a rare earth based bond magnet is obtained. The production method for the rare earth based bond magnet is not limited to the method of injection molding mentioned above. For example, the compound for the rare earth based bond magnet may also be subjected to the compression molding so as to obtain a rare earth based bond magnet containing the R-T-B based permanent magnet powders and resins. When the rare earth based bond magnet is produced by compression molding, after prepared, the compound for the rare earth based bond magnet is filled into a mold with a predetermined shape. After the application of pressures, the molded product (i.e., the rare earth based bond magnet) with a predetermined shape is taken out from the mold. In the process of the molding and take-out of the compound for the rare earth based bond magnet using a mold, it can be performed by using a compression molding machine such as a mechanical press or an oil-pressure press and the like. Thereafter, the molded product is cured by putting it into a furnace such as a heating furnace or a vacuum drying oven and applying heat, thereby a rare earth based bond magnet is obtained.

The shape of the molded rare earth based bond magnet is not particularly limited. Corresponding to the shape of the mold in use such as a tabular shape, a columnar shape and a shape with the section being circular, the shape of the rare earth based bond magnet vary accordingly. Further, with respect to the resulting rare earth based bond magnet, in order to prevent the oxidation layer, the resin layer and the like on the surface from deteriorating, the surface may be subjected to plating or coating.

When the compound for the rare earth based bond magnet is formed into the intended predetermined shape, the molded body derived from molding may also be oriented in a specific direction by applying a magnetic field. Thus, an anisotropic rare earth based bond magnet with better magnetic performances is obtained, as the rare earth based bond magnet is oriented in a specific direction.

An example of the production method of the rare earth based sintered magnet is described below. As mentioned above, the powders of the R-T-B based permanent magnet having a stacked structure are formed into an intended predetermined shape by compression molding or the like. The shape of molded body obtained by molding the powders of the R-T-B based permanent magnet with a stacked structure is not particularly limited. Corresponding to the shape of the mold in use such as a tabular shape, a columnar shape and a shape with the section being circular, the shape of the rare earth based sintered magnet vary accordingly.

Then, for example, a thermal treatment is applied to the molded body for 1 to 10 hours under vacuum or inert atmosphere at a temperature of 1000° C. to 1200° C. so as to perform the firing. Accordingly, a sintered magnet (a rare earth based sintered magnet) is obtained. After the firing, the resulting rare earth based sintered magnet is kept at a temperature lower than that during the firing, thereby an aging treatment is applied to these rare earth based sintered magnet. The treatment conditions of the aging treatment are appropriately adjusted depending on the times of applying the aging treatment. For example, the aging treatment may be a two-stage heating process in which heating is applied for 1 to 3 hours at 700° C. to 900° C. and then for 1 to 3 hours at 500° C. to 700° C.; or a one-stage heating process in which heating is performed for 1 to 3 hours at about 600° C. Such an aging treatment can improve the magnetic properties of the rare earth based sintered magnet.

The resulting rare earth based sintered magnet may be cut into desired sizes or the surfaces may be smoothed to be prepared to have a predetermined shape. Also, the resulting rare earth based sintered magnet may be subjected to plating or coating on the surfaces to prevent the oxidation layer or the resin layer or the like from deteriorating.

Furthermore, when the powders of the R-T-B based permanent magnet having a stacked structure is molded to have an intended predetermined shape, the molded body may be oriented in a specific direction by applying a magnetic field.

Thus, an anisotropic rare earth based sintered magnet with better magnetic performance can be obtained as the rare earth based sintered magnet is oriented in a specific direction.

Examples

Hereinafter, the present invention will be specifically described by Examples and Comparative Examples. However, the present invention is not limited by the following Examples.

As the target materials, the Nd—Fe—B alloyed target material, Pr—Fe—B alloyed target material and Ce—Fe—B alloyed target material were prepared by adjusting the sputtering-formed films to the composition of $Nd_{15}Fe_{78}B_7$, $Pr_{15}Fe_{78}B_7$ and $Ce_{15}Fe_{78}B_7$. The silicon substrate was prepared as the base material used for film formation. The conditions were set as follows. The target materials had a diameter of 76.2 mm, the size of the base material was 10 mm×10 mm, and the plane of the film was kept sufficiently uniform.

A device in which the gases can be evacuated to $10^{-8}$ Pa or less and a plurality of sputtering means were disposed in the same tank, was used as the film-forming device. Then, in the film-forming device, the Nd—Fe—B alloyed target material, Pr—Fe—B alloyed target material, Ce—Fe—B alloyed target material and Ta target material which was used for the base film and the protection film, were provided. Sputtering was performed by the magnetron sputtering in which Ar atmosphere of 1 Pa was set and the RF generator was used. The power of the RF generator and the time for film formation were adjusted according to the composition of the samples.

In the film formation, Ta was formed to a film of 50 nm as the base film. Then, the thicknesses of the R1-Fe—B layer and the Ce—Fe—B layer were adjusted according to each Example and Comparative Example, and the sputtering was performed accordingly. Similarly, the sputtering of Pr—Fe—B and that of Ce—Fe—B were performed. The sputtering proceeded through three methods based on the composition of the samples. In one method the sputtering of two target materials was alternatively performed, in the second method the sputtering of two target materials was performed simultaneously, and in the third method sputtering of one target material was performed. After the formation of the R—Fe—B film, Ta was formed to a film of 50 nm as the protection film.

During the film formation, the silicon substrate (i.e., the base material) was heated to 450° C. so as to crystallize the R—Fe—B film. For comparison, a part of the samples were heated to 600° C. After the film formation of the magnetic layer, a protection film was formed at 200° C. and was taken out of the firm-forming device after it was cooled to room temperature under vacuum. The prepared samples were shown in Table 1.

TABLE 1

| | Species of R1 | Ratio of R1:Ce | Thickness of R1—Fe—B Layer (nm) | Thickness of Ce—Fe—B layer (nm) | Number of Repetition (counts) | Film thickness of magnetic layer (nm) | Temperature for film formation (° C.) | Method for sputtering |
|---|---|---|---|---|---|---|---|---|
| Example 1 | Nd | 100.0:10.0 | 200.0 | 20.0 | 3 | 660.0 | 450 | Sputtering of two target materials performed alternatively |
| Example 2 | Nd | 10.0:100.0 | 20.0 | 200.0 | 3 | 660.0 | 450 | Sputtering of two target materials performed alternatively |
| Example 3 | Nd | 50.0:50.0 | 100.0 | 100.0 | 3 | 600.0 | 450 | Sputtering of two target materials performed alternatively |
| Example 4 | Nd | 92.0:8.0 | 184.0 | 16.0 | 3 | 600.0 | 450 | Sputtering of two target materials performed alternatively |
| Example 5 | Nd | 8.0:92.0 | 16.0 | 184.0 | 3 | 600.0 | 450 | Sputtering of two target materials performed alternatively |
| Example 6 | Nd | 50.0:50.0 | 400.0 | 400.0 | 3 | 2400.0 | 450 | Sputtering of two target materials performed alternatively |
| Example 7 | Pr | 100.0:10.0 | 200.0 | 20.0 | 3 | 660.0 | 450 | Sputtering of two target materials performed alternatively |
| Example 8 | Nd | 83.0:17.0 | 166.0 | 34.0 | 3 | 600.0 | 450 | Sputtering of two target materials performed alternatively |
| Example 9 | Nd | 50.0:50.0 | 300.0 | 300.0 | 3 | 1800.0 | 450 | Sputtering of two target materials performed alternatively |
| Example 10 | Nd | 50.0:50.0 | 0.6 | 0.6 | 500 | 600.0 | 450 | Sputtering of two target materials performed alternatively |
| Example 11 | Nd | 50.0:50.0 | 0.4 | 0.4 | 750 | 600.0 | 450 | Sputtering of two target materials performed alternatively |
| Example 12 | Nd | 66.7:33.3 | 0.8 | 0.4 | 500 | 600.0 | 450 | Sputtering of two target materials performed alternatively |
| Example 13 | Nd | 99.2:0.8 | 100.0 | 0.8 | 6 | 604.8 | 450 | Sputtering of two target materials performed alternatively |

TABLE 1-continued

| | Species of R1 | Ratio of R1:Ce | Thickness of R1—Fe—B Layer (nm) | Thickness of Ce—Fe—B layer (nm) | Number of Repetition (counts) | Film thickness of magnetic layer (nm) | Temperature for film formation (° C.) | Method for sputtering |
|---|---|---|---|---|---|---|---|---|
| Example 14 | Nd | 50.0:50.0 | 100.0 | 100.0 | 6 | 1200.0 | 450 | Sputtering of two target materials performed alternatively |
| Comparative Example 1 | Nd | 100.0:10.0 | 600.0 | 60.0 | — | 660.0 | 450 | Sputtering of two target materials performed simultaneously |
| Comparative Example 2 | Nd | 10.0:100.0 | 60.0 | 600.0 | — | 660.0 | 450 | Sputtering of two target materials performed simultaneously |
| Comparative Example 3 | Nd | 100.0:0.0 | 600.0 | 0.0 | — | 600.0 | 600 | Sputtering of one target material |
| Comparative Example 4 | Nd | 100.0:0.0 | 600.0 | 0.0 | — | 600.0 | 450 | Sputtering of one target material |

After the evaluation of the magnetic properties, the prepared samples were subjected to the inductively coupled plasma atomic emission spectroscopy (ICP-AES) in which the atomic ratio was confirmed to be in accordance with the designs.

The magnetic properties of each sample were measured using a vibrating sample magnetometer (VSM) by applying a ±4T magnetic field to the film's plane in a vertical direction. Table 2 showed the magnetic properties of the samples listed in Table 1. Measurement was performed at 23° C.

TABLE 2

| | Br (mT) | HcJ (kA/m) |
|---|---|---|
| Example 1 | 1115 | 939 |
| Example 2 | 952 | 859 |
| Example 3 | 1080 | 883 |
| Example 4 | 621 | 477 |
| Example 5 | 599 | 537 |
| Example 6 | 739 | 549 |
| Example 7 | 1085 | 955 |
| Example 8 | 1103 | 915 |
| Example 9 | 1079 | 879 |
| Example 10 | 1077 | 879 |
| Example 11 | 734 | 545 |
| Example 12 | 748 | 557 |
| Example 13 | 609 | 462 |
| Example 14 | 1082 | 883 |
| Comparative Example 1 | 350 | 159 |
| Comparative Example 2 | 350 | 151 |
| Comparative Example 3 | 415 | 263 |
| Comparative Example 4 | 249 | 87 |

If Examples and Comparative Examples 1 and 2 were compared, it could be known that better magnetic properties were maintained in Examples in which the sputtering of two target materials was performed alternatively. This was because the high magnetic anisotropy field of the R1-Fe—B based crystal layer was maintained while the crystallization temperature was lowered by the Ce—Fe—B based crystal layer by stacking the R1-Fe—B based crystal layer and the Ce—Fe—B based crystal layer.

Based on the comparison among Examples, it would be known that a balance was achieved between the high magnetic anisotropy field of the R1-Fe—B based crystal layer and the lowered crystallization temperature of the Ce-T-B based crystal layer if the atomic ratio of R1 to Ce (i.e., R1/Ce) was set to be 0.1 or more and 10 or less. Particularly, better magnetic properties were achieved.

By comparing the Examples, it could be known that the coercivity inducement mechanism from the single magnetic domains was also partially generated if the thickness of each of the R1-Fe—B based crystal layer and the Ce—Fe—B based crystal layer was set to be 0.6 nm or more and 300 nm or less. Particularly, a high coercivity was achieved.

If Comparative Example 1 and Example 7 were compared, it could be known that good magnetic properties would be maintained even if R1 was changed from Nd to Pr.

In the produced samples, a composition analysis to the sections was performed to investigate whether Ta (the base layer) was diffused into the magnetic film as the impurities. During the analysis, the samples were firstly processed by using a device of focused ion beam and then observed by a scanning transmission electron microscope (STEM). Further, element analysis was done via X-ray energy dispersive spectroscopy (EDS). The diameter of the spot in the EDS was 1 nm to 2 nm, and the center in the thickness direction of the Ta base film was set to be the measuring point 1. From that point, 5 points in total were analyzed in the direction towards the magnetic film in which the pitch between each two adjacent points was 100 nm except that the first two points were 50 nm apart. The results obtained by performing the same measuring at 5 points were then averaged. The samples from Example 3 and Comparative Example 3 were used, and the results were shown in Table 3.

TABLE 3

| | Measuring point | Nd (at %) | Ce (at %) | Fe (at %) | B (at %) | Ta (at %) |
|---|---|---|---|---|---|---|
| Example 3 | 1 | 0.0 | 0.0 | 0.0 | 0.0 | 100.0 |
| | 2 | 0.0 | 11.8 | 82.3 | 5.9 | 0.0 |
| | 3 | 11.8 | 0.0 | 82.4 | 5.8 | 0.0 |
| | 4 | 0.0 | 11.9 | 82.2 | 5.9 | 0.0 |
| | 5 | 11.8 | 0.0 | 82.2 | 6.0 | 0.0 |
| Comparative Example 3 | 1 | 0.0 | 0.0 | 0.0 | 0.0 | 100.0 |
| | 2 | 8.5 | 0.0 | 59.5 | 4.3 | 27.7 |
| | 3 | 9.6 | 0.0 | 67.1 | 4.9 | 18.4 |
| | 4 | 10.5 | 0.0 | 72.9 | 5.2 | 11.4 |
| | 5 | 10.9 | 0.0 | 75.8 | 5.4 | 7.9 |

Based on the composition analysis in Example 3, it was known that a stacked structure of the R1-Fe—B based crystal layer and the Ce—Fe—B based crystal layer were formed and the diffusion of the Ta base layer can be prevented at a film-forming temperature of 450° C. On the other hand, it was known that a R1-Fe—B based single crystal layer was formed in Comparative Example 3, but the diffusion of Ta base layer occurred at a film-forming temperature of 600° C. Thus, the magnetic properties deemed to be worse than the predicated ones, showing the influence of the diffusion of the Ta base layer.

In Comparative Example 4, the R1-Fe—B based single crystal layer was produced at a film-forming temperature of 450° C. However, the magnetic properties were extremely bad that it was considered that the crystallization could not sufficiently proceed.

What is claimed is:

1. A R-T-B based permanent magnet, comprising a R-T-B based structure in which a R1-T-B based crystal layer and a Ce-T-B based crystal layer are stacked, wherein:

R1 represents at least one rare earth element selected from the group consisting of Nd, Pr, Dy, Tb, and Ho;

T represents at least one transition metal element comprising Fe or a combination of Fe and Co;

an atomic ratio of R1 to Ce is 0.1 or more and 10 or less; and each of the R1-T-B based crystal layer and the Ce-T-B based crystal layer has a thickness of 0.6 nm or more and 300 nm or less.

2. A R-T-B based permanent magnet powder, comprising a R-T-B based structure in which a R1-T-B based crystal layer and a Ce-T-B based crystal layer are stacked, wherein:

R1 represents at least one rare earth element selected from the group consisting of Nd, Pr, Dy, Tb, and Ho;

T represents at least one transition metal element comprising Fe or a combination of Fe and Co;

an atomic ratio of R1 to Ce is 0.1 or more and 10 or less; and each of the R1-T-B based crystal layer and the Ce-T-B based crystal layer has a thickness of 0.6 nm or more and 300 nm or less.

3. A bond magnet comprising the R-T-B based permanent magnet powder of claim 1.

4. A sintered magnet comprising the R-T-B based permanent magnet powder of claim 1.

* * * * *